US011830444B2

(12) United States Patent
Guynes et al.

(10) Patent No.: US 11,830,444 B2
(45) Date of Patent: Nov. 28, 2023

(54) MODIFY BRIGHTNESS OF DISPLAYS USING PIXEL LUMINANCE

(71) Applicant: HEWLETT-PACKARD DEVELOPMENT COMPANY, L.P., Spring, TX (US)

(72) Inventors: Tim Guynes, Houston, TX (US); John W Frederick, Houston, TX (US); Humberto M Fossati, Houston, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/482,289

(22) PCT Filed: Jun. 29, 2017

(86) PCT No.: PCT/US2017/040123
§ 371 (c)(1),
(2) Date: Jul. 31, 2019

(87) PCT Pub. No.: WO2019/005079
PCT Pub. Date: Jan. 3, 2019

(65) Prior Publication Data
US 2020/0111429 A1 Apr. 9, 2020

(51) Int. Cl.
*G09G 3/34* (2006.01)
*G09G 3/36* (2006.01)

(52) U.S. Cl.
CPC ..... *G09G 3/3406* (2013.01); *G09G 3/3611* (2013.01); *G09G 2320/0247* (2013.01); *G09G 2320/0626* (2013.01); *G09G 2360/16* (2013.01)

(58) Field of Classification Search
None
See application file for complete search history.

(56) References Cited

U.S. PATENT DOCUMENTS

| | | | | |
|---|---|---|---|---|
| 7,352,410 | B2 | 4/2008 | Chou | |
| 7,948,563 | B2 | 5/2011 | Sono | |
| 9,077,906 | B1 | 7/2015 | Tsai et al. | |
| 2003/0107682 | A1* | 6/2003 | Sono | H04N 5/57 348/687 |

(Continued)

FOREIGN PATENT DOCUMENTS

| | | |
|---|---|---|
| CN | 101227562 C | 7/2008 |
| EP | 1217598 | 6/2008 |

(Continued)

OTHER PUBLICATIONS

Integrating Ambient Light Sensors with Computers Running Windows 8, Sep. 28, 2012, https://www.google.co.in/url?sa=t&rct=j&q=&esrc=s&source=web&cd=5&cad=rja&uact=8&ved=0ahUKEwj.

*Primary Examiner* — Benjamin X Casarez
(74) *Attorney, Agent, or Firm* — QUARLES & BRADY LLP

(57) ABSTRACT

In some examples, a display can modify brightness of displays using pixel luminance by detecting a luminance of pixels included on the display, and modifying a screen brightness of the display by modifying a brightness of a backlight of the display within a predetermined time when the detected luminance of the pixels on the display exceeds a predetermined luminance threshold.

18 Claims, 4 Drawing Sheets

(56) References Cited

U.S. PATENT DOCUMENTS

2003/0146919 A1* 8/2003 Kawashima ..... H04N 21/44008 345/609
2005/0168490 A1* 8/2005 Takahara ..... G09G 3/3241 345/690
2006/0028401 A1 2/2006 Webb et al.
2008/0055519 A1 3/2008 Battersby et al.
2008/0158268 A1* 7/2008 Hui ..... G09G 3/2022 345/691
2009/0085862 A1* 4/2009 Takaku ..... G09G 3/3406 345/102
2009/0244408 A1* 10/2009 Kamada ..... H04N 5/50 348/790
2009/0284545 A1* 11/2009 Watanabe ..... G09G 3/3611 345/589
2010/0134527 A1* 6/2010 Inada ..... G09G 3/3426 345/690
2010/0295879 A1* 11/2010 Tanaka ..... G09G 3/3426 345/690
2010/0328359 A1* 12/2010 Inoue ..... G09G 3/2077 345/690
2010/0328535 A1* 12/2010 Okui ..... G09G 3/3406 348/578
2011/0249035 A1 10/2011 Masahiro
2012/0075353 A1 3/2012 Dong et al.
2014/0015869 A1* 1/2014 Takahashi ..... G09G 3/3406 345/102
2014/0146089 A1* 5/2014 Kuno ..... G09G 3/3406 345/690
2014/0292632 A1* 10/2014 Chen ..... G09G 3/3406 345/102
2015/0103105 A1 4/2015 Kim et al.
2015/0325176 A1* 11/2015 Koyama ..... G09G 3/3406 345/690
2015/0379922 A1* 12/2015 Zhang ..... G09G 3/3208 345/690
2016/0111047 A1* 4/2016 Yamato ..... G09G 3/3611 345/102
2016/0148579 A1* 5/2016 Kimura ..... G09G 3/3607 345/694
2016/0293102 A1 10/2016 Chaji
2017/0061901 A1* 3/2017 Zhang ..... G09G 3/3426
2017/0270872 A1* 9/2017 Morimoto ..... G09G 3/3406
2017/0293205 A1* 10/2017 Iwata ..... H04N 1/2116
2019/0258114 A1* 8/2019 Kwon ..... G09G 3/34

FOREIGN PATENT DOCUMENTS

EP 2333764 6/2011
JP 10340069 12/1998
KR 100274994 B1 7/1999

* cited by examiner

MODIFY BRIGHTNESS OF DISPLAYS USING PIXEL LUMINANCE

BACKGROUND

Displays may modify brightness levels of screens of the displays. Some displays may modify the contrast ratio based on the media being displayed on the screen. The ratio of the luminance of the white color levels to the black color levels the display is capable of producing can be referred to as a contrast ratio. For example, a display can increase a brightness level of the screen for content on the screen having a lighter image, and decrease a brightness level of the screen for content on the screen having a darker image.

DETAILED DESCRIPTION

Some displays may modify a brightness of the display based on the media being displayed on the screen of the display. For example, the screen brightness of the display can be darkened based on darker media content, and the screen brightness of the display can be lightened based on lighter media content.

In some instances, as the media content being displayed on the screen varies between light and dark, the brightness of the screen can correspondingly vary. In some examples, the brightness changes of the screen corresponding to changes between light and dark of the media content being displayed can lead to screen flicker. The screen flicker can be exaggerated in examples in which the brightness changes of the screen lag behind the changes of the media content displayed on the screen.

Modifying brightness of displays using pixel luminance can allow for modification of brightness of a screen of a display according to the media content displayed on the display while reducing or eliminating screen flicker. Modifying the brightness of displays using pixel luminance may reduce instances of light leakage and allow for easier compliance with power consumption specifications.

Figure 1:
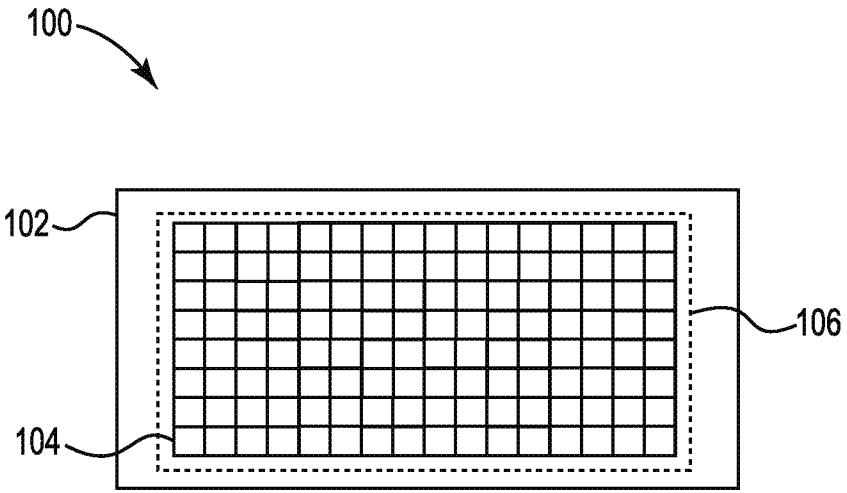
FIG. 1 illustrates an example of a display suitable to modify brightness of displays using pixel luminance consistent with the disclosure.

FIG. 1 illustrates an example of a display 102 suitable to modify brightness of displays using pixel luminance consistent with the disclosure. Display 102 can include a screen 104 and pixels 106.

As used herein, the term "display" can, for example, refer to an output device which can display information via a screen. A display may include a television, computer monitor, mobile device screen, other type of display device, or any combination thereof, which can receive and output a video signal. The display can be a liquid crystal display (LCD). As used herein, the term "LCD display" can, for example, refer to a display that uses light-modulating properties of liquid crystals and a backlight to produce images on the display.

Display 102 can detect a luminance of pixels 106 included on display 102. As used herein, the term "pixel" can, for example, refer to a smallest controllable element of a picture represented on a screen. A pixel can be a red, green, and blue (RGB) sub-pixel. A pixel or sub-pixel of an LCD display can include a layer of molecules aligned between two transparent electrodes and two polarizing filters. Pixels 106 can include the total set of all pixels included on a screen on a display. The amount of pixels on a screen included on a display can be the resolution of the display.

As used herein, the term "screen" can, for example, refer to a viewing surface of a display. As used herein, the term "luminance" can, for example, refer to a photometric measure of the luminous intensity per unit of area of light travelling in a given direction. In other words, luminance can describe an amount of light that passes through, is emitted, or is reflected from a particular area. For example, the luminance of a pixel of a screen can describe a luminous intensity of the pixel of the screen.

For example, display 102 can detect an amount of light that passes through pixels 106 of screen 104 included on display 102. For instance, display 102 can detect the luminance of pixels 106 to be 103 candelas per square meter ($cd/m^2$). One candela per square meter can hereinafter be referred to as a "nit". For example, 103 $cd/m^2$ can be referred to as 103 nits.

The luminance of pixels 106 of display 102 can be an average luminance. For example, display 102 can detect an average luminance of pixels 106 of display 102.

Display 102 can detect the luminance of pixels 106 by calculating red, green, and blue (RGB) values of pixels 106 included on display 102. For example, display 102 can calculate the RGB values of pixels 106 to determine the luminance of pixels 106. Continuing with the example from above, display 102 can calculate the RGB values of pixels 106 to determine the luminance of pixels 106 of display 102 to be 103 nits.

RGB values of pixels 106 may be determined using voltage data received by display 102 via a video signal. For example, a video signal received by display 102 from a computing device, mobile device, and/or other device capable of outputting a video signal to display 102 can include voltages that display 102 may utilize to determine RGB values of pixels 106.

Display 102 can calculate the RGB values of pixels 106 to determine an average luminance of pixels 106. For example, the RGB values of each pixel 106 can be calculated, and an average luminance of pixels 106 of display 102 can be calculated from the RGB values of each pixel 106.

In some examples, display 102 can calculate the RGB values of a sub-set of pixels 106. A sub-set of pixels of the total set of pixels 106 on display 102 can be a sub-set of pixels that includes less than the total set of pixels 106 of display 102. For example, display 102 can calculate the RGB values of a sub-set of pixels, where the sub-set of pixels may include pixels on a top edge of screen 104, a bottom edge of screen 104, the left edge of screen 104, the right edge of screen 104, pixels in an interior of screen 104 (e.g., pixels not adjacent to the top, bottom, left, or right edges of screen 104), and/or any other combination thereof.

In some examples, display 102 can utilize a sensor to measure luminance of pixels 106. For instance, in some examples display 102 can utilize a grid of sensors in back of the backlight of display 102 to measure luminance of pixels 106. The grid of sensors can be in back of a backlight diffusion layer of the display 102 and can measure pixel luminance inside the panel layers of display 102 comprising pixels 106. In some examples, display 102 can utilize edge sensors integrated into a bezel of display 102 to measure luminance of pixels 106 at the front of display 102.

Display 102 can modify a screen brightness of display 102 by modifying a brightness of a backlight of display 102. As used herein, the term "backlight" can, for example, refer to a light source included in display 102 to illuminate screen 104 of display 102 in order to produce a visible image on screen 104. The backlight can be comprised of light-emitting diodes (LEDs), cold cathode fluorescent lamps (CCFLs), hot cathode fluorescent lamps (HCFLs), external electrode fluorescent lamps (EEFLs), and/or can be an electroluminescent panel (ELF), among other types of backlights. As used herein, the term "brightness" can, for example, refer to an attribute of visual perception elicited by a luminance of a visual target (e.g., a backlight of display 102).

Display 102 can modify the screen brightness of display 102 within a predetermined time when the detected luminance of pixels 106 on display 102 exceeds a predetermined luminance threshold. As used herein, the term "exceed" can, for example, refer to a value crossing a bound, where the value can be increasing until the value crosses the bound and/or decreasing until the value crosses the bound. For instance, display 102 can modify the screen brightness of display 102 when the detected luminance of pixels 106 on display 102 is increased until the detected luminance of pixels 106 crosses the predetermined luminance threshold and/or when the detected luminance of pixels 106 on display 102 is decreased until the detected luminance of pixels 106 crosses the predetermined luminance threshold.

For example, as information displayed on display 102 changes, the luminance of pixels 106 can also change. When the luminance of pixels 106 exceeds a predetermined luminance threshold, display 102 can modify the screen brightness of display 102. For example, information displayed on display 102 can correspond to a luminance of 95 nits with a predetermined luminance threshold of 103 nits. In some examples, as the information displayed changes, the luminance of pixels 106 can change from 95 nits to 150 nits, and display 102 can correspondingly brighten the screen brightness of display 102 as a result of the luminance of pixels 106 exceeding the predetermined luminance threshold of 103 nits. In some examples, as the information displayed changes, the luminance of pixels 106 can change from 150 nits to 95 nits, and display 102 can correspondingly darken the screen brightness of display 102 as a result of the luminance of pixels 106 exceeding the predetermined luminance threshold of 103 nits.

In some examples, display 102 can use a set of luminance thresholds based on a use profile of display 102, For example, a use profile of display 102 can utilize four luminance thresholds such that as the luminance of pixels 106 is increased or decreased based on the information displayed on display 102, the display 102 can correspondingly modify the screen brightness of display 102, as is further described herein.

In some examples, display 102 can modify the screen brightness of display 102 when the detected luminance of a sub-set of pixels of the total set of pixels 106 on display 102 exceeds a predetermined luminance threshold. For example, information displayed on display 102 can correspond to a sub-set of pixels of the total set of pixels 106 with a luminance of 95 nits where the predetermined luminance threshold is 103 nits. In some examples, as the information displayed changes, the luminance of the sub-set of pixels of the total set of pixels 106 can change from 95 nits to 150 nits, and display 102 can correspondingly brighten the screen brightness of display 102 as a result of the luminance of the sub-set of pixels of the total set of pixels 106 exceeding the predetermined luminance threshold of 103 nits. In some examples, as the information displayed changes, the luminance of the sub-set of pixels of the total set of pixels 106 can change from 150 nits to 95 nits, and display 102 can correspondingly darken the screen brightness of display 102 as a result of the luminance of the sub-set of pixels of the total set of pixels 106 exceeding the predetermined luminance threshold of 103 nits.

Display 102 can modify the screen brightness of display 102 within a predetermined time when the detected luminance of pixels 106 on display 102 exceeds the luminance threshold. In other words, when the detected luminance of pixels 106 exceeds the luminance threshold, display 102 can modify the screen brightness within a predetermined time. For example, when the detected luminance of pixels 106 exceeds the luminance threshold of 103 nits (e.g., the luminance of pixels 106 increases from 95 nits to 150 nits), display 102 can modify the screen brightness in ten milliseconds. Display 102 can control modification of the screen brightness of display 102 using a scaler. As used herein, the term "scaler" can, for example, refer to a system that can modify timing parameters and a video signal resolution that can be output to the display. The scaler included in display 102 can control the speed of the modification of the screen brightness of display 102.

Although display 102 is described above as modifying the screen brightness of display 102 within a predetermined time of ten milliseconds when the detected luminance of pixels 106 on display 102 exceeds the luminance threshold, examples of the disclosure are not so limited. For example, display 102 can modify the screen brightness in less than ten milliseconds or more than ten milliseconds.

Display 102 can modify the screen brightness of display 102 by turning the backlight of display 102 off when the detected luminance of pixels 106 indicates a black screen. For example, when the luminance of pixels 106 is zero, or near zero such as when the luminance of pixels 106 is within a threshold black pixel luminance (e.g., 5 nits or less), display 102 can turn off the backlight of display 102. Turning off the backlight of display 102 at a zero or near zero luminance of pixels 106 can increase black levels of display 102, and can allow display 102 to realize energy savings relative to keeping the backlight of display 102 turned on at zero or near zero luminance of pixels 106.

In some examples, display 102 can delay turning off the backlight of display 102 by a predetermined amount of time when the detected luminance of pixels 106 indicates a black screen. Display 102 can delay turning off the backlight in response to no active information and/or media content being displayed on display 102 for the predetermined amount of time. For example, in response to the detected luminance of pixels 106 indicating a black screen, and in response to no active information and/or media content being displayed on display 102 for five seconds, display 102 can turn off the backlight of display 102. In an example in which information and/or media content is displayed before the predetermined amount of delay time, display 102 can refrain from turning off the backlight of display 102.

Although the predetermined amount of delay time by display 102 before turning off the backlight of display 102 is described above as being five seconds, examples of the disclosure are not so limited. For example, the predetermined amount of delay time can be more than five seconds or less than five seconds. Delaying turning off the backlight by display 102 can prevent a flashing effect that may be experienced by a user as the black screen condition of pixels 106 may be temporary.

Display 102 can modify the screen brightness of display 102 by turning the backlight of the display 102 to a maximum brightness when the detected luminance of pixels 106 indicates a white screen. For example, when the luminance of pixels 106 is at a maximum (e.g., 255 nits), or near maximum such as when the luminance of pixels 106 is within a threshold white pixel luminance (e.g., 250 nits or more), display 102 can turn the backlight of display 102 to a maximum or near maximum brightness setting. Increasing the backlight of display 102 to a maximum or near maximum brightness at a maximum or near maximum luminance of pixels 106 can increase white levels of display 102.

Display 102 can modify the screen brightness of display 102 when the detected luminance of pixels 106 exceeds one of a plurality of different predetermined luminance thresholds. As described above, display 102 can include various sets of luminance thresholds. Each set of luminance thresholds can include a different number of luminance thresholds and can include luminance thresholds that may differ in values between sets. In some examples, a first set of luminance thresholds can include twenty luminance thresholds such that display 102 can modify the screen brightness of display 102 any time the luminance of pixels 106 exceeds one of the twenty luminance thresholds. In some examples, a second set of luminance thresholds can include five luminance thresholds such that display 102 can modify the screen brightness of display 102 any time the luminance of pixels 106 exceeds one of the five luminance thresholds. The luminance thresholds included in the first set and the second set can have different values, as is further described herein.

Each set of luminance thresholds can correspond to different use profiles of display 102. For example, display 102 can include an adaptive use profile including a first set of luminance thresholds, a progressive use profile including a second set of luminance thresholds, and/or a power saving use profile including a third set of luminance thresholds, among other types of use profiles and luminance threshold sets. The set of luminance thresholds corresponding to each use profile may include different luminance thresholds.

Display 102 can include an adaptive use profile, a progressive use profile, and/or a power saver use profile, among other types of use profiles. Display 102 can modify the screen brightness when the detected luminance of pixels 106 exceeds a luminance threshold included in a set of luminance thresholds associated with a selected use profile of the display 102. For example, a user of display 102 may have selected the adaptive use profile, and display 102 can modify the screen brightness of display 102 when the detected luminance of pixels 106 exceeds a luminance threshold included in the set of luminance thresholds associated with the adaptive use profile. Similarly, display 102 can modify the screen brightness of display 102 when the detected luminance of pixels 106 exceeds a luminance threshold included in the set of luminance thresholds associated with the progressive use profile or the set of luminance thresholds associated with the power saver use profile. In other words, each use profile can include a set of luminance thresholds that can be distinct from other sets of luminance thresholds included in other use profiles. Display 102 can modify the screen brightness of display 102 when the detected luminance of pixels 106 exceeds a luminance threshold included in a set of luminance thresholds associated with a selected use profile of display 102.

In some examples, the use profile of display 102 can be an adaptive use profile. The adaptive use profile can include a first set of predetermined luminance thresholds. For example, the adaptive use profile can include twenty predetermined luminance thresholds. Display 102 can modify the screen brightness of display 102 after a predetermined delay (e.g., one second) and within a predetermined time (ten milliseconds) for each instance of the detected luminance of pixels 106 exceeding one of the twenty predetermined luminance thresholds of the first set of predetermined luminance thresholds associated with the adaptive use profile.

Although the adaptive use profile is described as including twenty predetermined luminance thresholds and display 102 is described as modifying the screen brightness of display 102 within ten milliseconds, examples of the disclosure are not so limited. For example, the adaptive use profile can include more than twenty or less than twenty predetermined luminance thresholds and display 102 can modify the screen brightness of display 102 faster than ten milliseconds or slower than ten milliseconds.

As described above, display 102 can modify a screen brightness of display 102 by modifying a brightness of the backlight of display 102 after a predetermined time when the detected luminance of pixels 106 exceeds the predetermined luminance threshold for the adaptive use profile. In other words, display 102 can delay modifying the screen brightness by the backlight of the display 102 by a predetermined time when display 102 is using the adaptive use profile.

For example, when the detected luminance of pixels 106 exceeds the luminance threshold of 103 nits (e.g., the luminance of pixels 106 increases from 95 nits to 150 nits), display 102 can wait one second (e.g., the predetermined delay time) and then effect the modification of the screen brightness in ten milliseconds (e.g., the predetermined screen modification time). In other words, the predetermined delay time before modifying the screen brightness can be different than the predetermined time to effect the screen brightness modification.

Although display 102 is described above as delaying modifying the brightness of the backlight of display 102 by one second, examples of the disclosure are not so limited. For example, display 102 can delay modifying the screen brightness by less than one second or more than one second. In other words, the predetermined delay time for modifying the backlight of the display 102 can be less than one second or more than one second.

In some examples, when the detected luminance of pixels 106, within the predetermined delay time, exceeds more than one luminance threshold (e.g., as the detected luminance of pixels 106 increases or decreases), display 102 can modify the screen brightness of display 102 after the predetermined delay time based on the last threshold exceeded. For example, when the detected luminance of pixels 106 exceeds a first luminance threshold and a second luminance threshold within the predetermined delay time, display 102 can modify the screen brightness of display 102 after the predetermined delay time based on the second luminance threshold being the last threshold exceeded.

In some examples, when the detected luminance of pixels 106, within the predetermined delay time, exceeds a luminance threshold as the detected luminance of pixels 106 increases and then exceeds the same luminance threshold as the detected luminance of pixels 106 decreases, display 102 can refrain from modifying the screen brightness of display 102. In some examples, when the detected luminance of pixels 106, within the predetermined delay time, exceeds a luminance threshold as the detected luminance of pixels 106 decreases and then exceeds the same luminance threshold as the detected luminance of pixels 106 increases, display 102 can refrain from modifying the screen brightness of display 102. In other words, display 102 can refrain from modifying the screen brightness of display 102 when the detected luminance of pixels 106 exceeds a threshold, and then exceeds the same threshold again within the predetermined delay time.

For example, a predetermined luminance threshold can be 103 nits. The detected luminance of pixels 106 can increase from 95 nits to 150 nits, exceeding the predetermined luminance threshold of 103 nits, and then exceed the luminance threshold of 103 nits again when the luminance of pixels 106 decreases from 150 nits to 97 nits. Where the detected luminance of pixels 106 increases from 95 nits to 150 nits and decreases from 150 nits to 97 nits within the predetermined delay time (e.g., within one second), display 102 can refrain from modifying the screen brightness of display 102.

Delaying the modification of the brightness of the backlight of display 102 for the adaptive use profile can allow for an averaging affect as experienced by a user of display 102. The delayed brightness modification of the backlight can reduce screen flicker that can be associated with fast brightness changes of the display 102 that may otherwise be experienced by a user of the display 102.

In some examples, the use profile of display 102 can be a progressive use profile. The progressive use profile can include a second set of predetermined luminance thresholds, where the second set of predetermined luminance thresholds can include fewer luminance thresholds than the first set of luminance thresholds. For example, the progressive use profile can include five predetermined luminance thresholds. Display 102 can modify the screen brightness of display 102 within ten milliseconds each time the detected luminance of pixels 106 exceeds one of the five predetermined luminance thresholds of the second set of predetermined luminance thresholds associated with the progressive use profile.

Although the progressive use profile is described as including five predetermined luminance thresholds and display 102 is described as modifying the screen brightness of display 102 within ten milliseconds, examples of the disclosure are not so limited. For example, the progressive use profile can include more than five or less than five predetermined luminance thresholds or not more predetermined luminance thresholds than the adaptive use profile. Display 102 can modify the screen brightness of display 102 faster than ten milliseconds or slower than ten milliseconds.

In some examples, the use profile of display 102 can be a power saver use profile. The power saver use profile can include a third set of predetermined luminance thresholds. The third set of predetermined thresholds can include a maximum luminance threshold corresponding to a screen brightness of display 102 that is less than a screen brightness of display 102 associated with a similar luminance threshold of the second set of predetermined luminance thresholds. For example, third set of predetermined luminance thresholds can include a luminance threshold of 200 nits that can be associated with a first screen brightness of display 102. The second set of predetermined luminance thresholds associated with the progressive use profile can include a luminance threshold of 200 nits that can be associated with a second screen brightness, where the second screen brightness can be brighter than the first screen brightness. In other words, the power saver use profile and the progressive use profile can have different screen brightness's for a same or similar luminance threshold. The screen brightness associated with the power saver use profile can be less than the screen brightness of associated with the progressive use profile, allowing for power savings relative to the adaptive use profile and progressive use profiles.

In some examples, the third set of predetermined luminance thresholds of the power saver use profile can include threshold values that can be higher than the second set of predetermined luminance thresholds of the progressive use profile. For example, the progressive use profile can include a maximum predetermined luminance threshold of 200 nits that can cause display 102 to modify the screen brightness of display 102 to a maximum brightness setting, and the power saver use profile can include a maximum predetermined luminance threshold of 255 nits that can cause display 102 to modify the screen brightness of display 102 to a maximum brightness setting. As a result of the maximum predetermined luminance threshold of 200 nits of the progressive use profile, display 102 is more likely to modify the screen brightness of display 102 to the maximum brightness setting as a result of the lower predetermined luminance threshold (e.g., 200 nits) relative to the predetermined luminance threshold associated with the maximum brightness setting of the power saver use profile (e.g., 255 nits).

Display 102 can modify the screen brightness of display 102 within ten milliseconds each time the detected luminance of pixels 106 exceeds one of the five predetermined luminance thresholds of the third set of predetermined luminance thresholds associated with the power saver use profile.

Display 102 can determine a new luminance threshold for a use profile of display 102. For example, display 102 can determine a new luminance threshold for the adaptive use profile, the progressive use profile, and/or the power saver use profile. The new luminance threshold can be utilized such that when the detected luminance of pixels 106 exceeds the new luminance threshold, display 102 can modify the screen brightness of display 102.

Display 102 can determine a new luminance threshold when display 102 is in a learning use profile. For example, when display 102 is in a learning use profile, display 102 can determine a new luminance threshold for the adaptive use profile, the progressive use profile, and/or the power saver use profile.

Display 102 can determine a new luminance threshold by detecting a luminance of pixels 106 included on display 102 based on a test pattern displayed on display 102. For example, pixels 106 can display a test pattern, and display 102 can detect a luminance of pixels 106 with the test pattern displayed.

Display 102 can determine the new luminance threshold based on the detected test pattern luminance of pixels 106. For example, based on the test pattern, pixels 106 can be at a luminance of 211 nits. Based on the test pattern causing pixels 106 to be at a luminance of 211 nits, the new luminance threshold can be 211 nits. The new luminance threshold of 211 nits can be included as a predetermined luminance threshold in the adaptive use profile, the progressive use profile, and/or the power saver use profile, among other use profiles of display 102.

Display 102 can generate test patterns that may result in different brightness levels. For example, RGB values of pixels 106 can be selected to result in a test pattern that can allow display 102 to determine a new luminance threshold. For example, Red can be selected as 240, Green can be selected as 224, and Blue can be selected as 0, resulting in a yellow color test pattern that has a particular brightness level. The particular brightness level of the yellow color can correspond to a particular luminance of pixels 106, which accordingly may be used as a predetermined luminance threshold for the adaptive use profile, the progressive use profile, and/or the power saver use profile, among other use profiles of display 102.

Modifying brightness of displays using pixel luminance can allow for a reduction in screen flicker experienced by a user, as well as lower power consumption of a display based on the use profile selected. Displays may be provided to customers with a use profile selected, which can allow for modification of brightness turned on as an out-of-the-box setting (e.g., enabled for the first use) while meeting power regulations, which may increase customer satisfaction relative to displays without modification of brightness using pixel luminance consistent with the disclosure.

Figure 2:
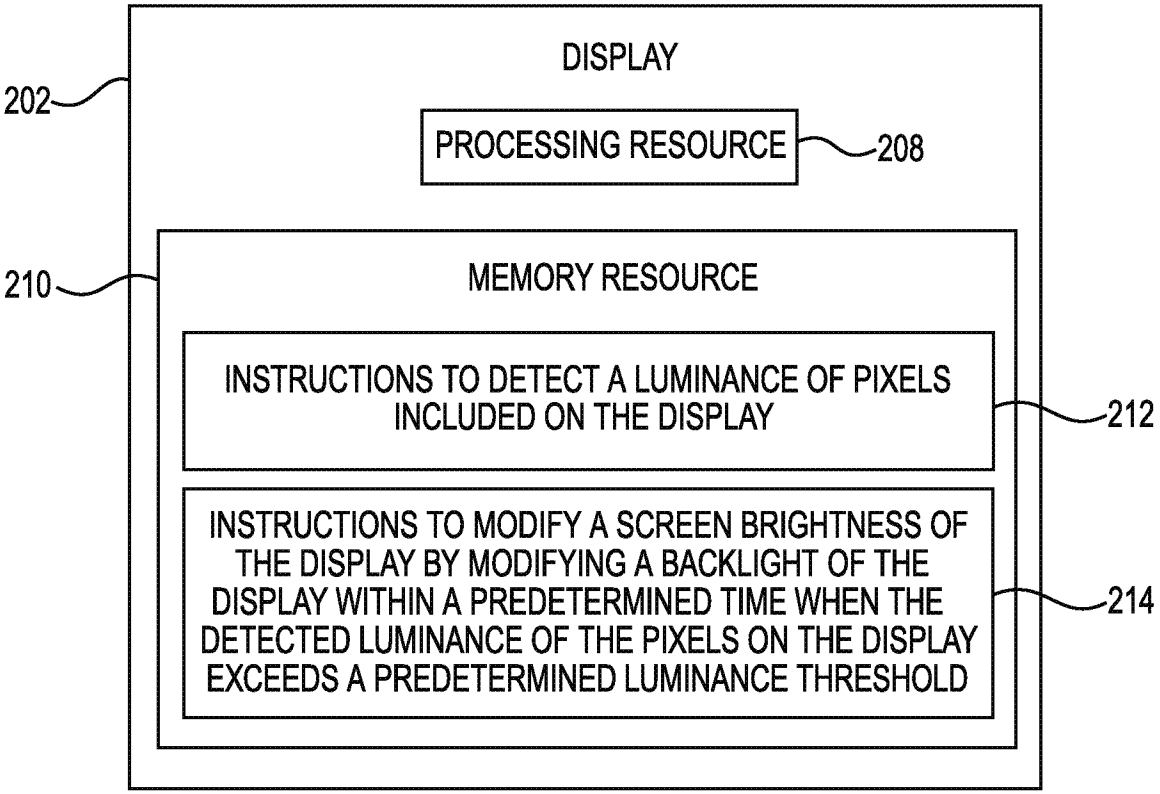
FIG. 2 illustrates a block diagram of an example of a display consistent with the disclosure.

FIG. 2 illustrates a block diagram of an example of a display 202 consistent with the disclosure. Display 202 (e.g., display 102, previously described in connection with FIG. 1) can include a processing resource 208 and a memory resource 210. Memory resource 210 can include machine readable instructions, including detect a luminance of pixels instructions 212 and modify a screen brightness of the display instructions 214.

Processing resource 208 may be a central processing unit (CPU), a semiconductor based microprocessor, and/or other hardware devices suitable for retrieval and execution of machine-readable instructions 212, 214 stored in a memory resource 210. Processing resource 208 may fetch, decode, and execute instructions 212, 214. As an alternative or in addition to retrieving and executing instructions 212, 214, processing resource 208 may include a plurality of electronic circuits that include electronic components for performing the functionality of instructions 212, 214.

Memory resource 210 may be any electronic, magnetic, optical, or other physical storage device that stores executable instructions 212, 214 and/or data. Thus, memory resource 210 may be, for example, Random Access Memory (RAM), an Electrically-Erasable Programmable Read-Only Memory (EEPROM), a storage drive, an optical disc, and the like. Memory resource 210 may be disposed within display 202, as shown in FIG. 2. Additionally and/or alternatively, memory resource 210 may be a portable, external or remote storage medium, for example, that allows display 202 to download the instructions 212, 214 from the portable/external/remote storage medium.

Processing resource 208 may execute detect a luminance of pixels instructions 214 stored in memory resource 210 to detect a luminance of pixels included on display 202. Display 202 can detect a luminance of pixels included on display 202 by calculating RGB values of the pixels included on display 202. The RGB values of the pixels included on display 202 can be used to determine the luminance of the pixels included on display 202.

Processing resource 208 may execute modify a screen brightness of the display instructions 214 to modify a screen brightness of the display by modifying a backlight of the display within a predetermined time when the detected luminance of the pixels on the display exceeds a predetermined luminance threshold. For example, a backlight of display 202 can be modified by display 202, where modification of the backlight of display 202 can cause the screen brightness of display 202 to be modified.

Figure 3:
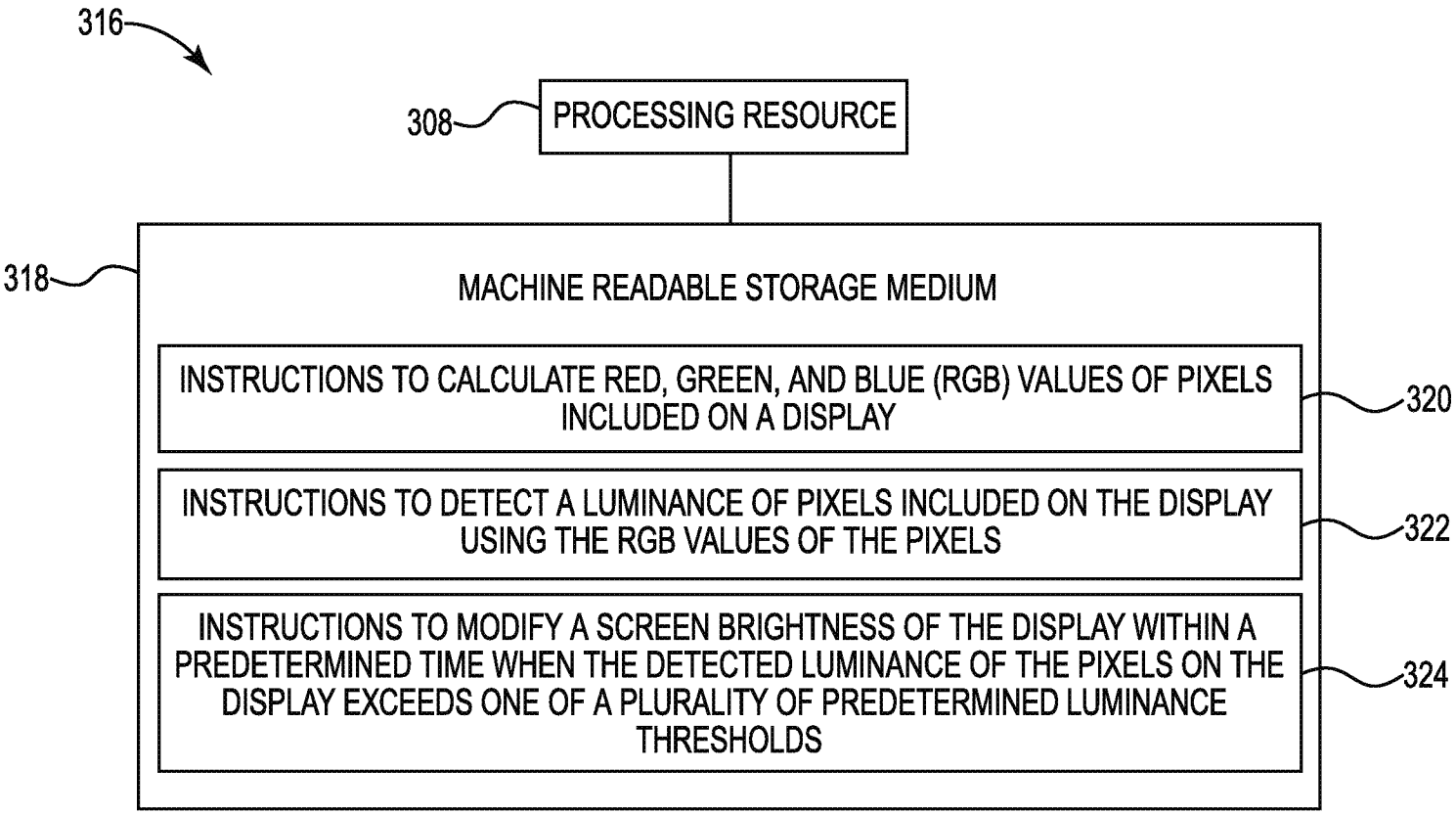
FIG. 3 illustrates a block diagram of an example of a system suitable to modify brightness of displays using pixel luminance consistent with the disclosure.

FIG. 3 illustrates a block diagram of an example of a system 316 suitable to modify brightness of displays using pixel luminance consistent with the disclosure. In the example of FIG. 3, system 316 includes a processing resource 308 (e.g., processing resource 208, previously described in connection with FIG. 2) and a machine readable storage medium 318. Although the following descriptions refer to an individual processing resource and an individual machine readable storage medium, the descriptions may also apply to a system with multiple processing resources and multiple machine readable storage mediums. In such examples, the instructions may be distributed across multiple machine readable storage mediums and the instructions may be distributed across multiple processing resources. Put another way, the instructions may be stored across multiple machine readable storage mediums and executed across multiple processing resources, such as in a distributed computing environment.

Processing resource 308 may be a central processing unit (CPU), microprocessor, and/or other hardware device suitable for retrieval and execution of instructions stored in machine readable storage medium 318. In the particular example shown in FIG. 3, processing resource 308 may receive, determine, and send instructions 320, 322, and 324. As an alternative or in addition to retrieving and executing instructions, processing resource 308 may include an electronic circuit comprising an electronic component for performing the operations of the instructions in machine readable storage medium 318. With respect to the executable instruction representations or boxes described and shown herein, it should be understood that part or all of the executable instructions and/or electronic circuits included within one box may be included in a different box shown in the figures or in a different box not shown.

Machine readable storage medium 318 may be any electronic, magnetic, optical, or other physical storage device that stores executable instructions. Thus, machine readable storage medium 318 may be, for example, Random Access Memory (RAM), an Electrically-Erasable Programmable Read-Only Memory (EEPROM), a storage drive, an optical disc, and the like. The executable instructions may be "installed" on the system 316 illustrated in FIG. 3. Machine readable storage medium 318 may be a portable, external or remote storage medium, for example, that allows the system 316 to download the instructions from the portable/external/remote storage medium. In this situation, the executable instructions may be part of an "installation package". As described herein, machine readable storage medium 318 may be encoded with executable instructions related to modifying brightness of displays using pixel luminance. That is, using processing resource 308, machine readable storage medium 318 may instruct a display to modify a screen brightness of the display within a predetermined time, among other operations.

Instructions 320 to calculate RGB values of pixels included on a display, when executed by processing resource 308, may cause system 316 to calculate RGB values of pixels included on the display. For example, RGB values of pixels included on the display can be calculated based on voltages from RGB data received by the display in a video signal.

Instructions 322 to detect a luminance of pixels, when executed by processing resource 308, may cause system 316 to detect a luminance of pixels included on the display using the RGB values of the pixels. For example, an average luminance of the pixels included on the display can be determined using the RGB values of the pixels of the display.

Instructions 324 to modify a screen brightness of the display, when executed by processing resource 308, may cause system 316 to modify a screen brightness of the display within a predetermined time when the detected luminance of the pixels on the display exceeds one of a plurality of predetermined luminance thresholds. For example, the display can modify the screen brightness of the display within ten milliseconds when the determined luminance of the pixels on the display exceeds a predetermined luminance threshold.

Figure 4:
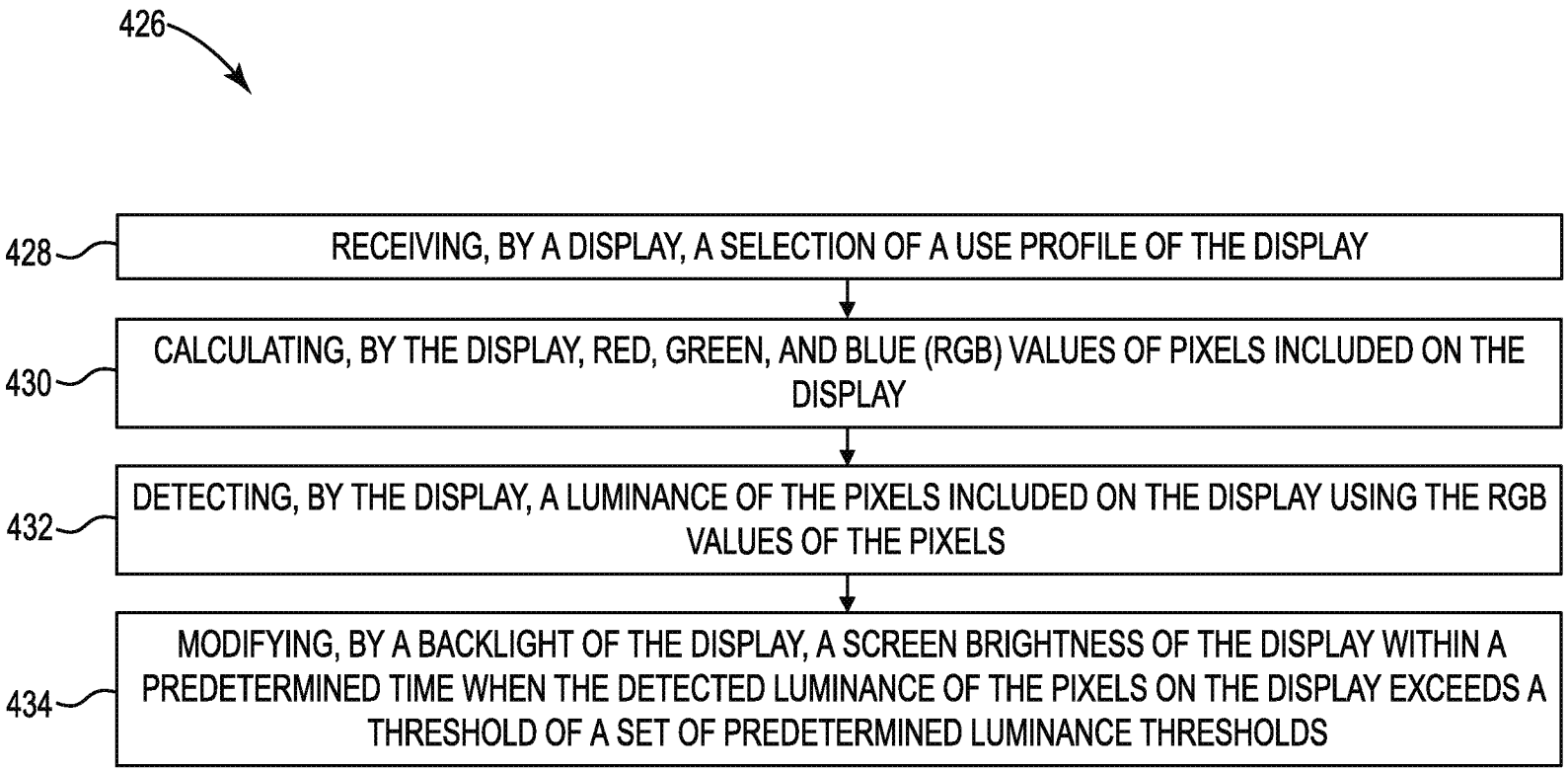
FIG. 4 illustrates an example of a method suitable to modify brightness of displays using pixel luminance consistent with the disclosure.

FIG. 4 illustrates an example of a method 426 suitable to modify brightness of displays using pixel luminance consistent with the disclosure. For example, method 426 can be performed by a display (e.g., display 102, 202, previously described in connection with FIGS. 1 and 2, respectively) to modify brightness of displays using pixel luminance.

At 428, the method 426 includes receiving, by a display, a selection of a use profile of the display. For example, the display can include different use profiles, including an adaptive use profile, a progressive use profile, and/or a power save use profile, among other use profiles. Each use profile can include a set of predetermined luminance thresholds, as is further described herein. Each set of predetermined luminance thresholds corresponding to each use profile can be different thresholds.

At 430, the method 426 includes calculating, by the display, RGB values of pixels included on the display. For example, the display can calculate RGB values of the pixels on the display using voltages of the pixels on the display.

At 432, the method 426 includes detecting, by the display, a luminance of the pixels included on the display based on the RGB values of the pixels. The luminance of the pixels can be an average luminance.

At 434, the method 426 includes modifying, by a backlight of the display, a screen brightness of the display within a predetermined time when the detected luminance of the pixels on the display exceeds a threshold of a set of predetermined luminance thresholds. For example, the display can modify the screen brightness of the display by modifying the backlight of the display within ten milliseconds when the detected luminance of the pixels on the display exceeds a luminance threshold.

The luminance thresholds can be different based on the use profile of the display. For example, the adaptive use profile can include twenty luminance thresholds, the progressive use profile can include five luminance thresholds, and the power saver use profile can include five luminance thresholds with a maximum luminance threshold that is less than the maximum luminance threshold of the progressive use profile. The adaptive use profile can include a predetermined delay time before modifying the screen brightness of the display when the detected luminance of the pixels on the display exceeds a luminance threshold of the adaptive use profile. In some examples, the luminance thresholds of each use profile can be different values.

As used herein, "logic" is an alternative or additional processing resource to perform a particular action and/or element described herein. Logic can include hardware. The hardware can include processing resources such as circuitry, which are distinct from machine-readable instructions on a machine readable media. Further, as used herein, "a" can refer to one such thing or more than one such thing.

The above specification, examples and data provide a description of the method and applications, and use of the system and method of the disclosure. Since many examples can be made without departing from the spirit and scope of the system and method of the disclosure, this specification merely sets forth some of the many possible example configurations and implementations.

What is claimed is:

1. A display, comprising:

a processing resource; and a memory resource storing machine readable instructions to cause the processing resource to:

detect a luminance of pixels included on the display;

detect the luminance of a sub-set of the pixels on the display cross a predetermined luminance threshold to a crossed side of the predetermined luminance threshold, wherein the predetermined luminance threshold is included in a set of luminance thresholds associated with a selected use profile;

in response to detecting the luminance of the sub-set cross the predetermined luminance threshold, refrain from modifying a screen brightness for a predetermined delay time associated with the selected use profile, wherein the predetermined delay time is at least one second; and modify the screen brightness of the display by modifying a brightness of a backlight of the display within a predetermined time in response to the detected luminance of the sub-set of the pixels being on the crossed side of the predetermined luminance threshold upon elapse of the predetermined delay time.

2. The display of claim 1, wherein the instructions to detect the luminance of the pixels include instructions to cause the processing resource to calculate red, green, and blue (RGB) values of the pixels included on the display.

3. The display of claim 1, wherein the selected use profile includes a plurality of predetermined luminance thresholds including the predetermined luminance threshold and a second predetermined luminance threshold.

4. The display of claim 1, wherein the instructions to modify the screen brightness of the display include instructions to turn a backlight of the display off when the detected luminance of the pixels indicates a black screen.

5. The display of claim 1, wherein the instructions to modify the screen brightness of the display include instructions to turn a backlight of the display to a maximum brightness when the detected luminance of the pixels indicates a white screen.

6. The display of claim 1, wherein the instructions to detect the luminance of the sub-set of the pixels include instructions to cause the processing resource to:

refrain from modifying the screen brightness of the display in response to the detected luminance of the sub-set of the pixels no longer being on the crossed side of the predetermined luminance threshold upon elapse of the predetermined delay time.

7. The display of claim 1, wherein the predetermined luminance threshold is a first predeteremined luminance threshold, wherein the set of luminance thresholds is a first set of luminance thresholds and the selected use profile is an adaptive use profile, and wherein the memory resource stores machine readable instructions to cause the processor resource to:

select a progressive use profile associated with a second set of luminance thresholds, detect a second luminance of the pixels included on the display while the progressive use profile is selected;

detect the second luminance of the sub-set of the pixels on the display cross a second predetermined luminance threshold to a crossed side of the second predetermined luminance threshold, wherein the second predetermined luminance threshold is included in the second set of luminance thresholds associated with the progressive use profile, and in response to detecting the second luminance of the sub-set cross the second predetermined luminance threshold, modify the screen brightness of the display by modifying a brightness of a backlight of the display within 10 milliseconds in response to the detected luminance of the sub-set of the pixels being on the crossed side of the predetermined luminance threshold.

8. A non-transitory machine readable storage medium having stored thereon machine readable instructions to cause a processing resource to:

calculate red, green, and blue (RGB) values of pixels included on a display;

detect a luminance of the pixels included on the display using the RGB values of the pixels;

determine when the luminance of a sub-set of the pixels crosses above a predetermined luminance threshold included in a set of luminance thresholds associated with a selected use profile;

in response to determining that the luminance of the sub-set crossed above the predetermined luminance threshold; refrain from modifying a screen brightness for a predetermined delay time associated with the selected user profile, wherein the predetermined delay time is at least one second;

detect the luminance of the sub-set of the pixels upon elapse of the predetermined delay time to determine if the luminance of the sub-set of the pixels remains above the predetermined luminance threshold; and modify a screen brightness of the display when the detected luminance of the sub-set of the pixels is above the predetermined luminance threshold upon elapse of the predetermined delay time.

9. The medium of claim 8, comprising instructions to cause the processing resource to modify the screen brightness of the display when the detected luminance of the sub-set of the pixels on the display crosses a different predetermined luminance threshold included in a different set of luminance thresholds associated with a different selectable use profile of the display.

10. The medium of claim 9, wherein the different selectable use profile that includes the different set of luminance thresholds utilize a reduced number of luminance thresholds compared to the selected use profile.

11. The method of claim 8, wherein the instructions to detect the luminance of the sub-set of the pixels include instructions to cause the processing resource to:

refrain from modifying the screen brightness of the display in response to the detected luminance of the sub-set of the pixels being below the predetermined luminance threshold upon elapse of the predetermined delay time.

12. A method, comprising:

receiving, by a display, a selection of a use profile of the display;

calculating, by the display, red, green, and blue (RGB) values of pixels included on the display;

detecting, by the display, a luminance of the pixels using the RGB values of the pixels;

determining, by the display, when the luminance of a sub-set of the pixels crosses above a predetermined luminance threshold included in a set of luminance thresholds associated with a selected use profile;

in response to determining that the luminance of the sub-set crossed above the predetermined luminance threshold, refraining, by the display, from modifying a screen brightness for a predetermined delay time associated with the selected use profile, wherein the predetermined delay time is at least one second;

detecting, by the display, the luminance of the sub-set of the pixels upon elapse of the predetermined delay time to determine if the luminance of the sub-set of the pixels remains above the predetermined luminance threshold; and modifying, by a backlight of the display, a screen brightness of the display when the detected luminance of the sub-set of the pixels is above the predetermined threshold for the selected use profile of the display upon elapse of the predetermined delay time.

13. The method of claim 12, wherein the method includes the predetermined delay time that is based on a selection of a power saving profile.

14. The method of claim 12, wherein the method includes the predetermined time delay being based on the selected use profile being an adaptive profile.

15. The method of claim 12, wherein the method includes modifying the screen brightness of the display when the detected luminance of the sub-set of the pixels on the display crosses a threshold of a second set of predetermined luminance thresholds based on the selected profile being a progressive profile.

16. The method of claim 15, wherein the method includes:

modifying the screen brightness of the display when the detected luminance of the sub-set of the pixels on the display crosses a threshold of a third set of predetermined luminance thresholds based on the selected profile being a power save profile;

wherein the third set of predetermined luminance thresholds includes a maximum luminance threshold that is less than the maximum luminance threshold of the second set of predetermined luminance thresholds.

17. The method of claim 12, wherein the method includes determining, by the display, a new luminance threshold for a use profile of the display by:

detecting a luminance of the sub-set of the pixels included on the display based on a test pattern displayed on the display; and determining the new luminance threshold based on the detected test pattern luminance of the sub-set of the pixels.

18. The method of claim 12, wherein the method includes:

determining, by the display, a second crossing of the predetermined luminance threshold by the luminance of a sub-set of the pixels;

in response to determining the second crossing of the predetermined luminance threshold, refraining, by the display, from modifying the screen brightness for the predetermined delay time;

detecting, by the display, the luminance of the sub-set of the pixels upon elapse of the predetermined delay time after the second crossing to determine if the luminance of the sub-set of the pixels remains above the predetermined luminance threshold; and refraining from modifying a screen brightness of the display when the detected luminance of the sub-set of the pixels is below the predetermined threshold upon elapse of the predetermined delay time after the second crossing.

* * * * *